US011737494B2

(12) United States Patent
Liu

(10) Patent No.: US 11,737,494 B2
(45) Date of Patent: Aug. 29, 2023

(54) ATOMIZATION ASSEMBLY AND ELECTRONIC CIGARETTE COMPRISING THE SAME

(71) Applicant: Shenzhen Eigate Technology Co., Ltd., Shenzhen (CN)

(72) Inventor: Tuanfang Liu, Shenzhen (CN)

(73) Assignee: ASPIRE NORTH AMERICA LLC

( * ) Notice: Subject to any disclaimer, the term of this patent is extended or adjusted under 35 U.S.C. 154(b) by 429 days.

(21) Appl. No.: 17/037,540

(22) Filed: Sep. 29, 2020

(65) Prior Publication Data

US 2021/0212369 A1 Jul. 15, 2021

(30) Foreign Application Priority Data

Jan. 15, 2020 (CN) ..... 202010067938.0

(51) Int. Cl.

| | |
|---|---|
| ***A24F 40/42*** | (2020.01) |
| ***A24F 40/46*** | (2020.01) |
| ***A24F 40/50*** | (2020.01) |
| ***A24F 40/44*** | (2020.01) |
| ***A24F 40/65*** | (2020.01) |
| ***A24F 40/10*** | (2020.01) |

(52) U.S. Cl.

CPC ..... *A24F 40/42* (2020.01); *A24F 40/10* (2020.01); *A24F 40/44* (2020.01); *A24F 40/46* (2020.01); *A24F 40/50* (2020.01); *A24F 40/65* (2020.01)

(58) Field of Classification Search

CPC ..... A24F 40/10; A24F 40/42; A24F 40/44; A24F 40/46; A24F 40/50; A24F 40/65

See application file for complete search history.

(56) References Cited

U.S. PATENT DOCUMENTS

| | | | | |
|---|---|---|---|---|
| 2017/0049152 | A1* | 2/2017 | Liu | H05B 3/44 |
| 2017/0304567 | A1* | 10/2017 | Adelson | A61M 11/042 |
| 2019/0104768 | A1* | 4/2019 | Domenici | A24F 40/46 |
| 2020/0100543 | A1* | 4/2020 | Welliver | A24F 40/10 |
| 2021/0022399 | A1* | 1/2021 | Clough | A24F 40/42 |
| 2021/0368869 | A1* | 12/2021 | Na | A24F 40/51 |

* cited by examiner

*Primary Examiner* — Abdullah A Riyami
*Assistant Examiner* — Thang H Nguyen
(74) *Attorney, Agent, or Firm* — Matthias Scholl P.C.; Matthias Scholl

(57) ABSTRACT

An atomization assembly, including a smoke material tank, a conducting inserter, and a ceramic heating element. The smoke material tank is transparent and includes graduations. The smoke material tank includes a puncturable bottom end. When in use, the conducting inserter pierces the puncturable bottom end so that a smoke material in the smoke material tank flows along an inlet of the conducting inserter into the ceramic heating element for vaporization.

4 Claims, 5 Drawing Sheets

ATOMIZATION ASSEMBLY AND ELECTRONIC CIGARETTE COMPRISING THE SAME

CROSS-REFERENCE TO RELATED APPLICATIONS

Pursuant to 35 U.S.C. § 119 and the Paris Convention Treaty, this application claims foreign priority to Chinese Patent Application No. 202010067938.0 filed Jan. 15, 2020, and to Chinese Patent Application No. 202020088740.6 filed Jan. 15, 2020. The contents of all of the aforementioned applications, including any intervening amendments thereto, are incorporated herein by reference, Inquiries from the public to applicants or assignees concerning this document or the related applications should be directed to: Matthias Scholl P. C., Attn.: Dr. Matthias Scholl Esq., 245 First Street, 18th Floor, Cambridge, Mass. 02142.

BACKGROUND

The disclosure relates to an atomization assembly and an electronic cigarette comprising the same.

The e-liquid tank of a conventional electronic cigarette includes no graduations. In addition, the conventional electronic cigarette is unable to limit the number of times of inhaling.

SUMMARY

The disclosure provides an atomization assembly, comprising a smoke material tank, a conducting inserter, and a ceramic heating element; the smoke material tank is transparent and comprises graduations; the smoke material tank comprises a puncturable bottom end; when in use, the conducting inserter pierces the puncturable bottom end so that a smoke material in the smoke material tank flows along an inlet of the conducting inserter into the ceramic heating element for vaporization.

In a class of this embodiment, the atomization assembly further comprises a wire rope, a silicone seal, and a limit cover; the wire rope is wrapped around the ceramic heating element to absorb the smoke material; the ceramic heating element is disposed in the silicone seal; the silicone seal is fixed in the limit cover; and the limit cover is in threaded connection to the conducting inserter.

In a class of this embodiment, the atomization assembly further comprises a first seal ring, an insulation ring, and a first joint; wherein the first seal ring is disposed on the top end of the limit cover; the insulation ring is disposed on a bottom end of the limit cover; and the first joint is disposed in the insulation ring.

Also provided is an electronic cigarette, comprising the aforesaid atomization assembly and a battery assembly; the components of the atomization assembly excluding a mouthpiece are disposed in a housing of the battery assembly; the battery assembly comprises a Bluetooth module communicating with a mobile phone Bluetooth.

In a class of this embodiment, when the Bluetooth module matches the mobile phone Bluetooth, a number of times of inhaling is set by a mobile phone; when the number of times of inhaling exceeds a preset value, the battery assembly outputs no power.

In a class of this embodiment, the battery assembly further comprises a control board, a battery cell and a power button; wherein an output end of the battery is soldered on an input end of the control panel; the power button is disposed on the control panel to power on or off a circuit of the control panel.

In a class of this embodiment, the Bluetooth module is disposed on the control panel; pressing the power button, and the circuit of the control panel is power on; and the Bluetooth module starts to work.

In a class of this embodiment, the connector of the atomization assembly is attracted by a magnet of the battery assembly.

The following advantages are associated with the electronic cigarette of the disclosure:

1. The smoke material tank is transparent and comprises graduations, which is easy for the user to observe the consumption of the smoke material and prevent the heating element from burning out.

2. The battery assembly comprises a Bluetooth module communicating with a mobile phone Bluetooth, and the number of times of inhaling is set by a mobile phone; when the number of times of inhaling exceeds a preset value, the battery assembly outputs no power.

DETAILED DESCRIPTION

To further illustrate, embodiments detailing an atomization assembly and an electronic cigarette comprising the same are described below. It should be noted that the following embodiments are intended to describe and not to limit the disclosure.

Smoke materials refer to smoke oil, tobacco, tobacco and other materials used to produce smoke.

Figure 1:
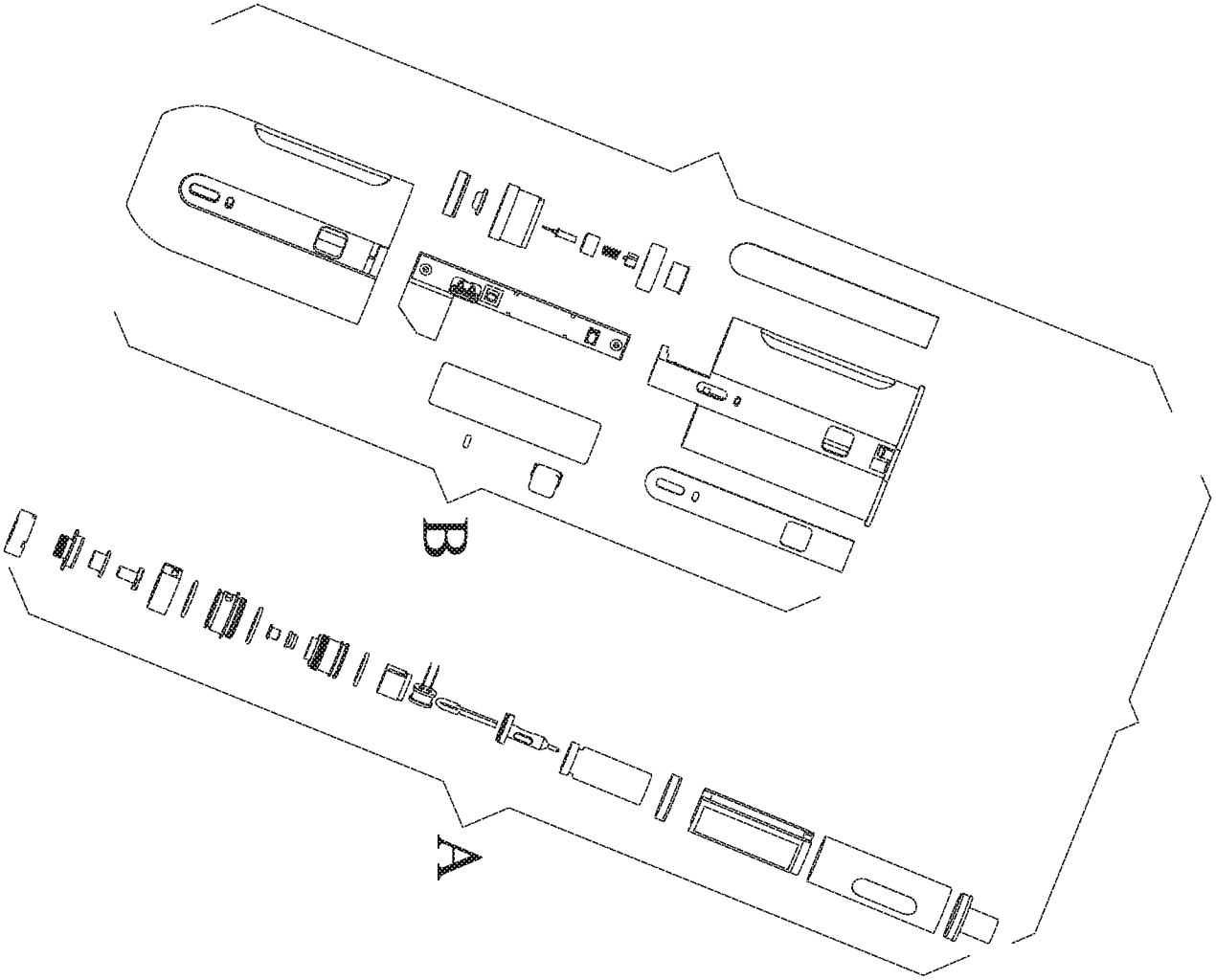
FIG. 1 is an exploded view of an electronic cigarette according to one embodiment of the disclosure.
Figure 2:
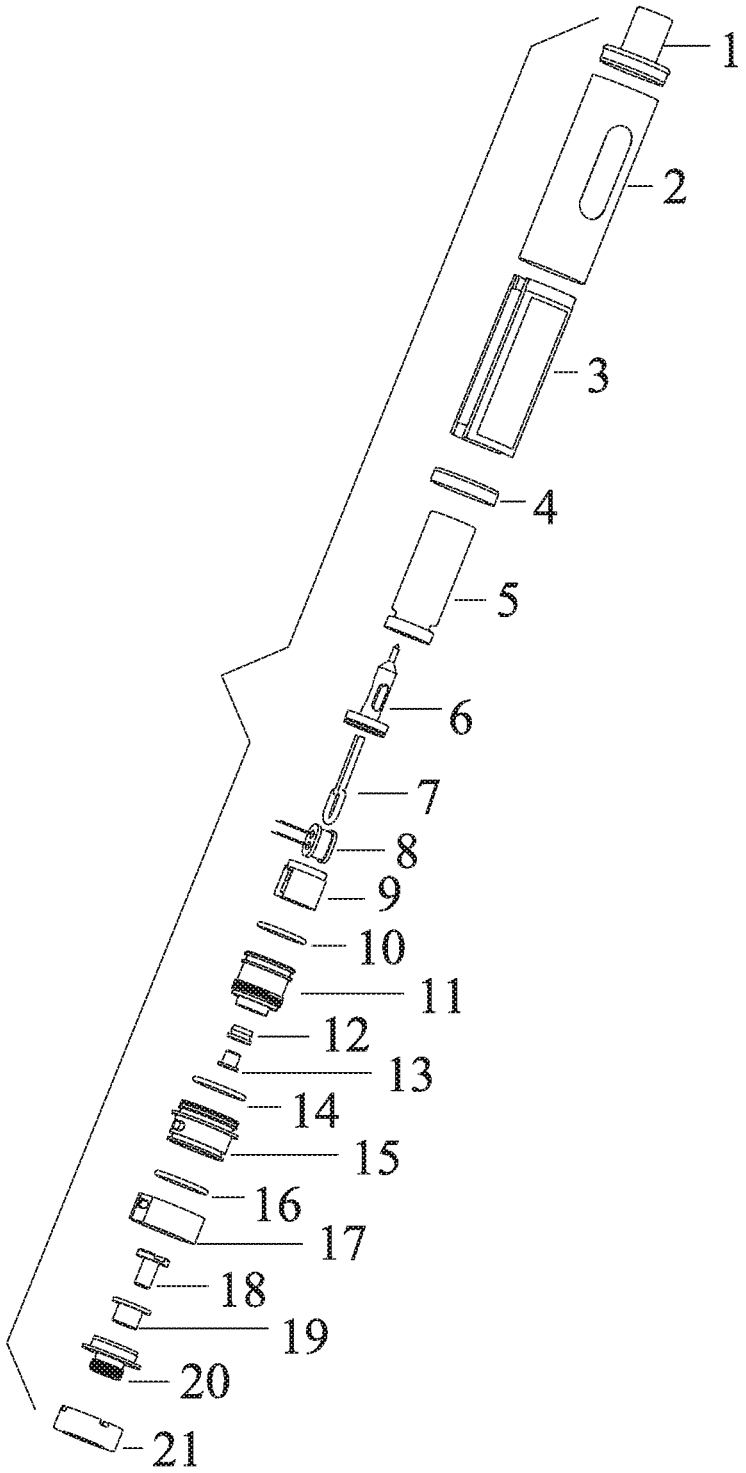
FIG. 2 is an exploded view of an atomization assembly of an electronic cigarette in FIG. 1.
Figure 3:
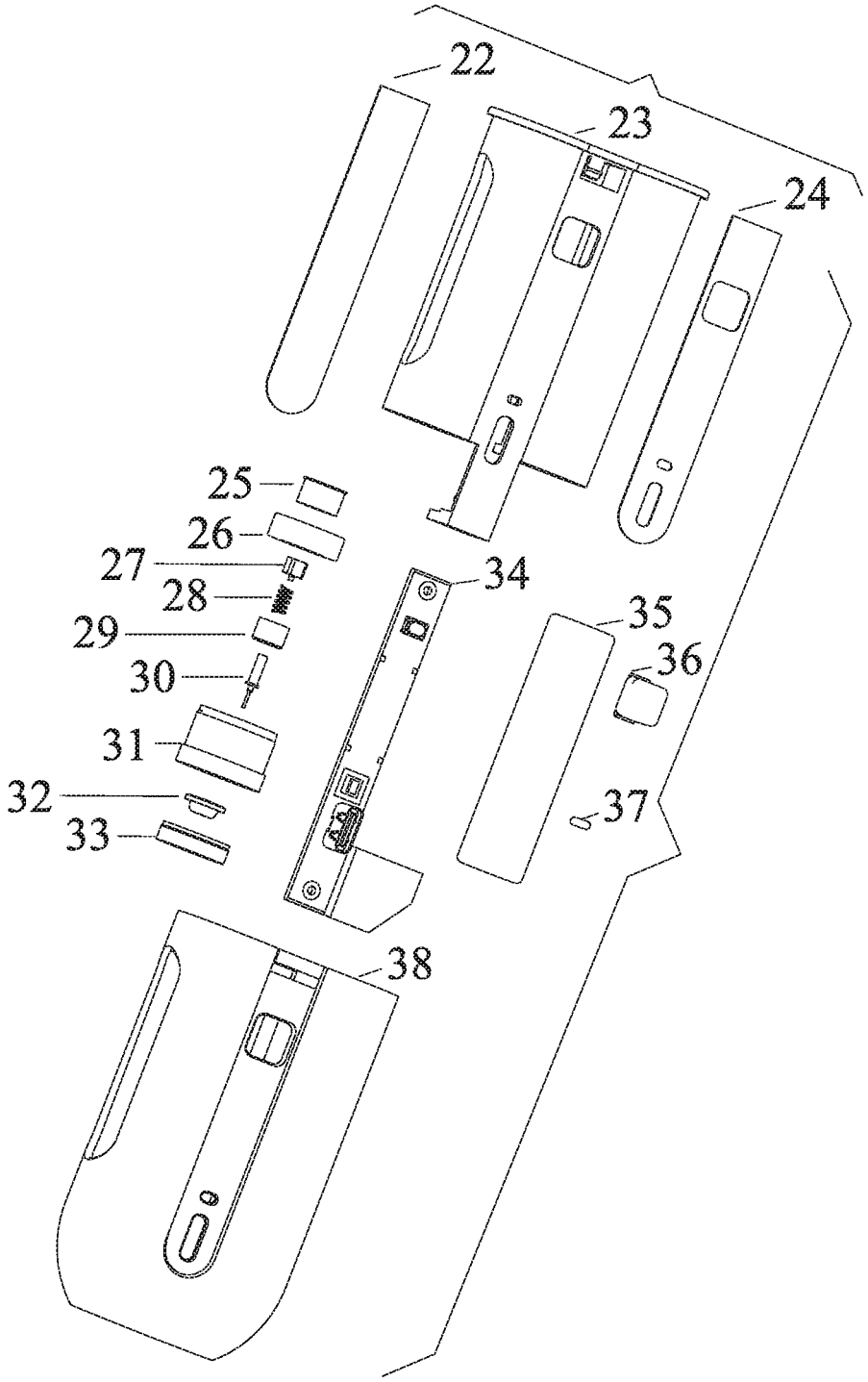
FIG. 3 is an exploded view of a battery assembly of an electronic cigarette in FIG. 1.
Figure 4:
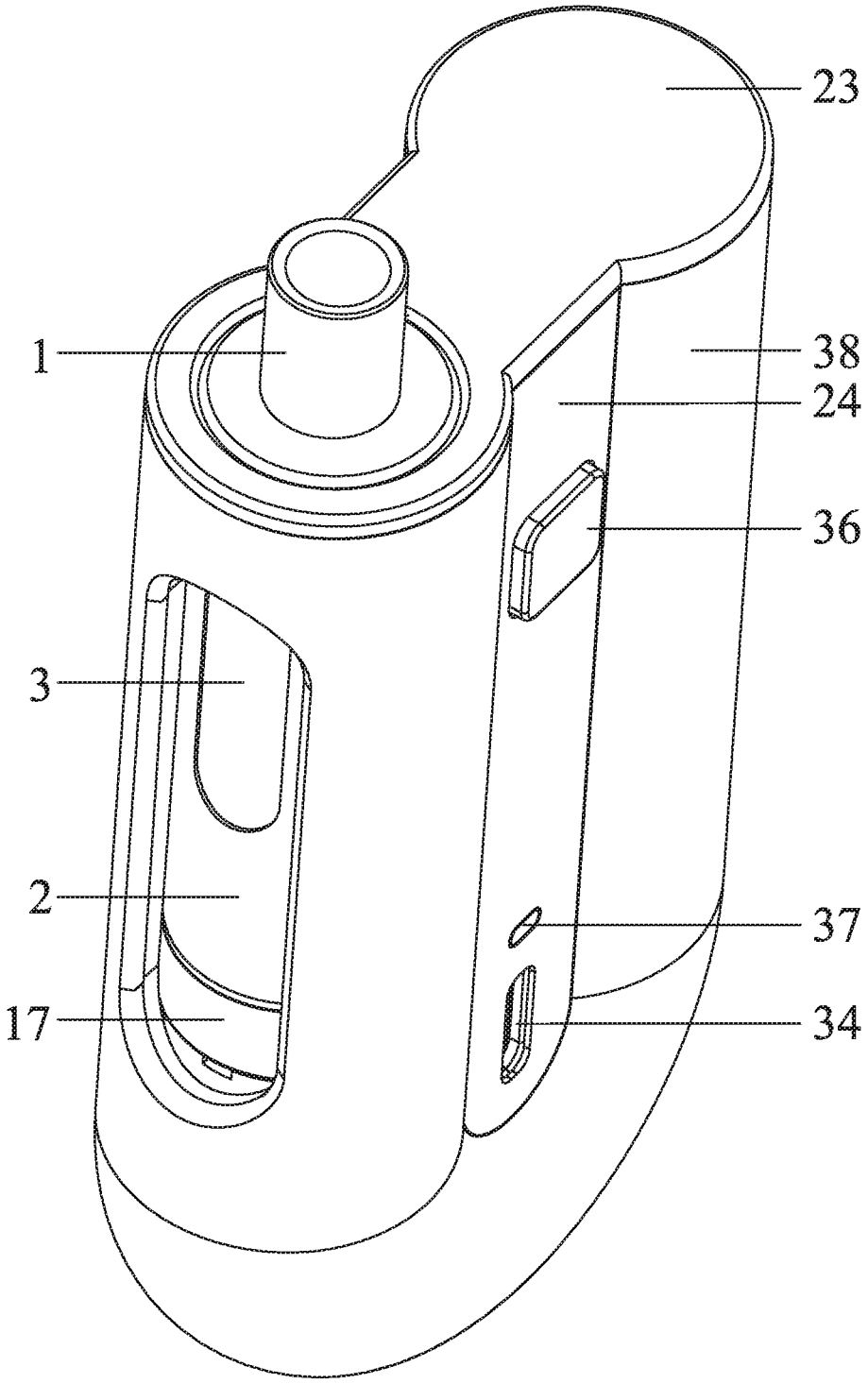
FIG. 4 a schematic diagram of an electronic cigarette according to another embodiment of the disclosure.
Figure 5:
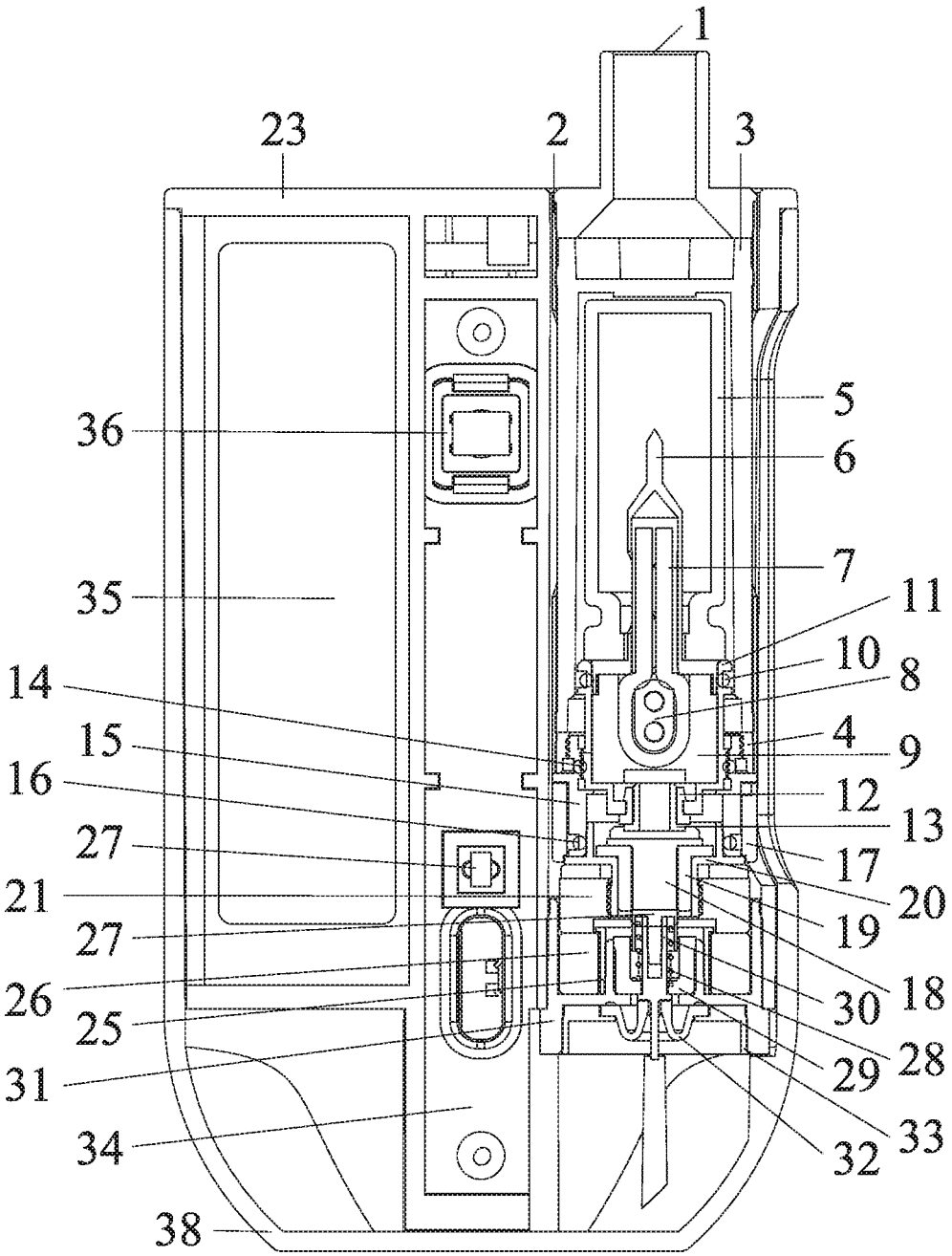
FIG. 5 is a sectional view of an electronic cigarette according to one embodiment of the disclosure.

As shown in FIGS. 1-5, an electronic cigarette comprises an atomization assembly A and a battery assembly B.

The atomization assembly A comprises a mouthpiece 1, a tube 2 comprising a window, a protection cover 3, a threaded ring 4, a smoke material tank 5, a conducting inserter 6, a wire rope 7, a ceramic heating element 8, a silicone seal 9, a first seal ring 10, a limit cover 11, an insulation ring 12, a first joint 13, a second sear ring 14, a first fixed seat 15, a third seal ring 16, an airflow regulation ring 17, a second joint 18, a seal plug 19, a base 20, and a connector 21. The wire rope 7 is wrapped around the ceramic heating element 8 to absorb the smoke material. The ceramic heating element 8 is disposed in the silicone seal 9. The silicone seal 9 is fixed in the limit cover 11. The limit cover 11 is in threaded connection to the conducting inserter 6. The bottom material of the smoke material tank 5 is aluminum foil sealed with silica gel. The top of the conducting inserter 6 pierces the aluminum foil at the bottom of the smoke material tank 5, so that the smoke material can flow along the inlet of the conducting inserter 6 into the ceramic heating element 8. The insulation ring 12 is disposed on the bottom end of the limit cover 11. The first joint 13 is disposed in the insulation ring 12. The first seal ring 10 is disposed on the top end of the limit cover 11. The second sear ring 14 is disposed on the first fixed seat 15. The third seal ring 16 is disposed on the first fixed seat 15 for sealing the airflow regulation ring 17. The airflow regulation ring 17 is disposed on the first fixed seat 15. The seal plug 19 is disposed in the base 20 for antileakage and insulation. The second joint 18 is disposed in the seal plug 19 for electric conduction. The base 20 is fixed on the bottom end of the first fixed seat 15 to fix the airflow regulation ring 17. The limit cover 11 is in threaded connection to the top end of the first fixed seat 15. The mouthpiece 1 is disposed on the top end of the tube 2. The protection cover 3 is disposed in the tube 2 to protect the smoke material tank 5. The threaded ring 4 is disposed on the bottom end of the tube 2 to fix the protection cover 3. The first fixed seat 15 is screwed onto the threaded ring 4 to fix the atomization assembly in the tube 2.

The battery assembly B comprises a first decorative sheet 22, a support 23, a second decorative sheet 24, a fixing ring 25, a magnet 26, a spring contact 27, a spring 28, an insulation cup 29, an electrode contact 30, a second fixed seat 31, a liquid stopper 32, a negative connecting ring 33, a control board 34, a battery cell 35, a power button 36, a light guide column 37, and a housing 38. The spring 28 is disposed around the electrode contact 30. The electrode contact 30 is disposed on the spring contact 27. The spring contact 27 is disposed in the insulation cup 29. The insulation cup 29 is disposed in the fixing ring 25. The fixing ring 25 is disposed in the magnet 26. The magnet 26 is disposed on the top end of the second fixed seat 31. The liquid stopper 32 is disposed on the top end of the electrode contact 30. The negative connecting ring 33 is disposed on the bottom end of the second fixed seat 31. The second fixed seat 31 is disposed in one side of the support 23. The control panel 34 is disposed on the front face of the support 23. The output end of the battery 35 is soldered on the input end of the control panel 34. The power button 36 is disposed on the control panel 34 to power on or off the circuit of the control panel 34. The battery 35 is disposed in a groove on one side of the support 23. The support 23 is disposed on the hosing 38. The first decorative sheet 22 and the second decorative sheet 24 are disposed on the back face and the front face of the housing, respectively. The light guide column 37 is disposed in a light guide hole of the housing 38.

The connector 21 of the atomization assembly A is attracted by the magnet 26 of the battery assembly B.

The following advantages are associated with the electronic cigarette of the disclosure:

1. The atomization assembly comprises a smoke material tank having graduations; the smoke material is stored in the smoke material tank. The smoke material tank is sealed by a silicone seal and aluminum foil. When in use, the conducting inserter pierces the puncturable bottom end so that the smoke material in the smoke material tank flows along the inlet of the conducting inserter into the ceramic heating element for vaporization.

2. The battery assembly comprises a Bluetooth module to control the number of times of inhaling. Thus, the inhaling times can be controlled to prevent the physical discomfort of the users caused by excessive smoking.

It will be obvious to those skilled in the art that changes and modifications may be made, and therefore, the aim in the appended claims is to cover all such changes and modifications.

What is claimed is:

1. An atomization assembly, comprising a smoke material tank, a conducting inserter, a ceramic heating element, a wire rope, a silicone seal, a limit cover, a first seal ring, an insulation ring, and a first joint wherein:

the smoke material tank is transparent and comprises graduations; the smoke material tank comprises a puncturable bottom end; when in use, the conducting inserter pierces the puncturable bottom end so that a smoke material in the smoke material tank flows along an inlet of the conducting inserter into the ceramic heating element for vaporization;

the wire rope is wrapped around the ceramic heating element to absorb the smoke material; the ceramic heating element is disposed in the silicone seal; the silicone seal is fixed in the limit cover; and the limit cover is in threaded connection to the conducting inserter; and the first seal ring is disposed on the top end of the limit cover; the insulation ring is disposed on a bottom end of the limit cover; and the first joint is disposed in the insulation ring.

2. An electronic cigarette, comprising an atomization assembly and a battery assembly; wherein:

the atomization assembly comprises a smoke material tank, a conducting inserter, and a ceramic heating element wherein the smoke material tank is transparent and comprises graduations; the smoke material tank comprises a puncturable bottom end; when in use, the conducting inserter pierces the puncturable bottom end so that a smoke material in the smoke material tank flows along an inlet of the conducting inserter into the ceramic heating element for vaporization;

the components of the atomization assembly excluding a mouthpiece are disposed in a housing of the battery assembly; the battery assembly comprises a Bluetooth module communicating with a mobile phone Bluetooth;

when the Bluetooth module matches the mobile phone Bluetooth, a number of times of inhaling is set by a mobile phone; when the number of times of inhaling exceeds a preset value, the battery assembly outputs no power; and the battery assembly further comprises a control board, a battery cell and a power button; wherein an output end of the battery is soldered on an input end of the control panel; the power button is disposed on the control panel to power on or off a circuit of the control panel.

3. The electronic cigarette of claim 2, wherein the Bluetooth module is disposed on the control panel; pressing the power button, and the circuit of the control panel is power on; and the Bluetooth module starts to work.

4. The electronic cigarette of claim 2, wherein a connector of the atomization assembly is attracted by a magnet of the battery assembly.

* * * * *